United States Patent [19]

Chevrette

[11] 4,145,768

[45] Mar. 27, 1979

[54] WATER CONSERVING URINAL

[76] Inventor: Clyde J. Chevrette, 766 Silver Ave., San Francisco, Calif. 94134

[21] Appl. No.: 827,136

[22] Filed: Aug. 24, 1977

[51] Int. Cl.[2] ..... A47C 29/00

[52] U.S. Cl. ..... 4/144.1; 4/DIG. 7; 4/119

[58] Field of Search ..... 4/97, 98, 95, 99, 110, 4/258, 262, 263, 187 R, 187 A, 114, 119, DIG. 7, 102, 207

[56] References Cited

U.S. PATENT DOCUMENTS

| | | | |
|---|---|---|---|
| 568,881 | 10/1896 | Simmonds et al. | 4/99 X |
| 1,718,450 | 6/1929 | Backus | 4/DIG. 7 |
| 2,498,502 | 2/1950 | O'Brien | 4/187 R |
| 3,964,110 | 6/1976 | Kapit | 4/102 X |

FOREIGN PATENT DOCUMENTS

| | | | |
|---|---|---|---|
| 361897 | 5/1962 | Switzerland | 4/3 |

*Primary Examiner*—Harry N. Haroian
*Attorney, Agent, or Firm*—Melvin R. Stidham

[57] ABSTRACT

A water conserving urinal comprising an open-top funnel to be mounted on the wall with a flexible hose thereon terminating in a rigid tube with a U-shaped gas trap section. The rigid tube trap extends into a sink drain pipe section adapted to be connected to the outlet of a sink drain trap, whereby liquids flow directly into the sewer line. A wall bracket has a horizontal cover panel from which the funnel is suspended when not in use.

7 Claims, 1 Drawing Figure

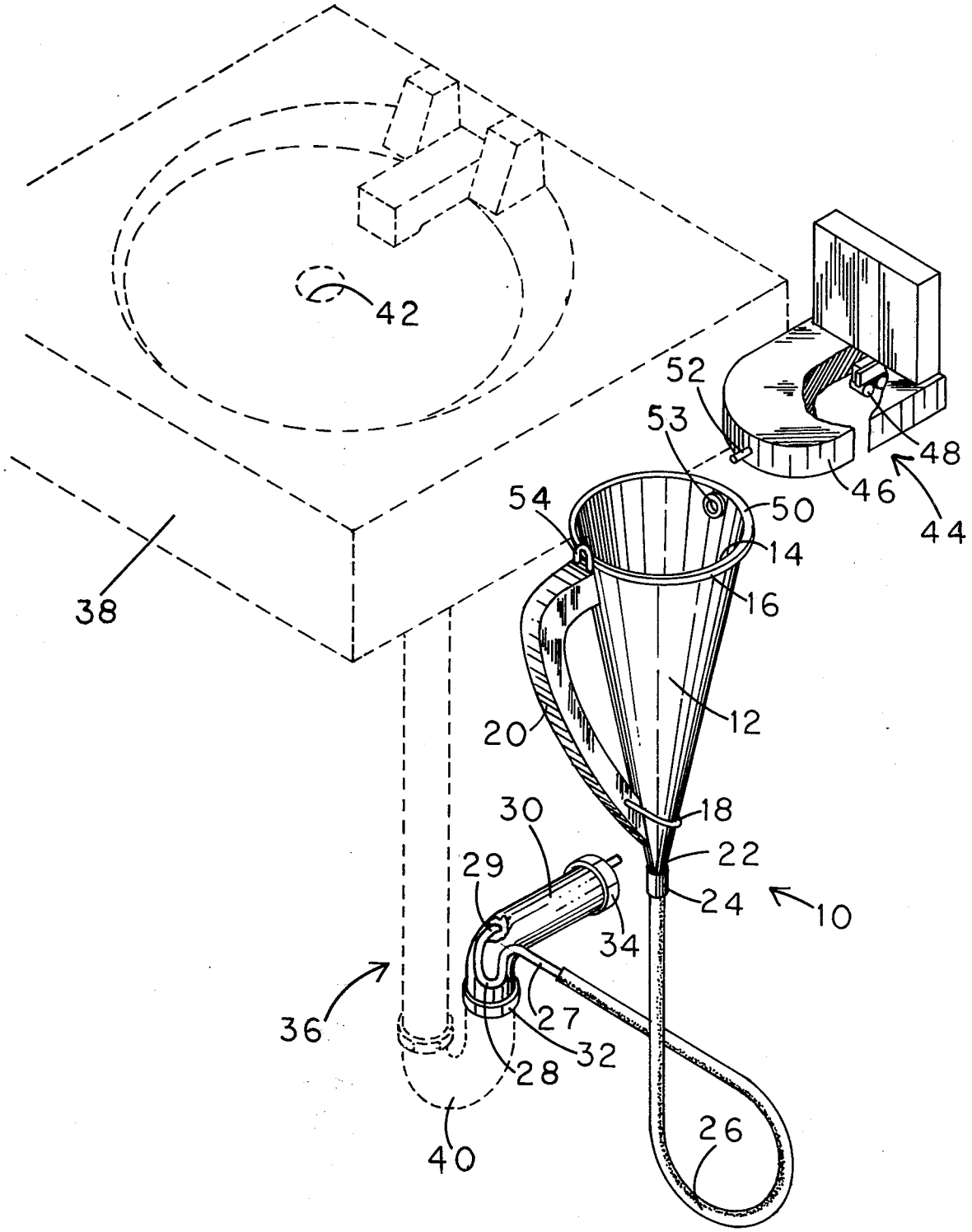
42
52
53
48
46
44
54
50
14
16
38
12
20
18
30
22
29
24
10
34
36
27
32
28
26
40

WATER CONSERVING URINAL

BACKGROUND OF THE INVENTION

In most residential bathroom and washroom installations, the conventional toilet is used for all body elimination functions and, usually, the toilet is flushed after each use. However, with increasing world population and, particularly in periods of drought, there is a growing concern over water consumption, and one of the most wasteful implements in the home is the conventional toilet which consumes six to eight gallons of water each time it is flushed. As a result, a number of different types of toilet installations have been proposed to use means other than the water flushing method for disposal but such have generally proved quite expensive as replacements for existing units and even in new installations. Others have proposed various devices for reducing the amount of water consumed during the flush but such have not proven adequate for all purposes, often requiring multiple flushing and consequently, even greater consumption of water. In severe times of drought, there have been wide campaigns to avoid flushing entirely, except when solid wastes were involved. However, such programs have proved less than completely satisfactory from a standpoint of hygiene.

OBJECTS OF THE INVENTION

It is an object of this invention to provide a water conserving urinal which may be flushed clean with a minimum consumption of water.

It is a further object of this invention to provide a water conserving urinal which requires but a minor fraction of the water normally consumed by flushing.

It is a further object of this invention to provide a water conserving urinal which is relatively sanitary and odor free.

It is a further object of this invention to provide a water conserving urinal which may be installed in existing bathroom facilities conveniently and inexpensively while conforming to present code requirements.

Other objects and advantages of this invention will become apparent from the description to follow, particularly when read in conjunction with the accompanying drawing.

SUMMARY OF THE INVENTION

In carrying out this invention, I provide a funnel-like receptacle to the side of which a handle is attached for convenience. A flexible hose is attached to the downspout of the funnel and the other end is connected to a short rigid tube of metal of the like including a U-shaped gas trap section. The metal tube is soldered into an opening cut in the wall of a sink drainpipe section adapted to be connected to the outlet of the sink trap. Hence, the drain trap connection may be broken and the existing section removed and replaced with the section forming a part of this unit. A wall bracket has horizontal cover panel with a spring clip underneath which grasps the rim of the funnel and, together with complementary hook means on the funnel and wall panel, hold the funnel in place with its open end against the under-surface of the wall bracket panel for storage when not in use.

BRIEF DESCRIPTION OF THE DRAWING

The drawing is an isometric view, partially broken away of the water conserving urinal of this invention.

DESCRIPTION OF A PREFERRED EMBODIMENT

Referring now to the drawing with greater particularity, the wall conserving urinal 10 of this invention includes a funnel 12 having an open top 14. The funnel may be of metal or plastic material, and is preferably smoothly contoured from top to bottom, as illustrated, for aesthetic appearances and to facilitate flush flowing action. Secured to the side of the funnel 12, as by means of metal straps 16 and 18, is a handle 20 which may be of wood, plastic or the like.

Connected to the downspout or outlet port 22 of the funnel, as by means of a resilient coupling sleeve 24, is a flexible house 26, preferably of surgical rubber, which may be of any suitable length. At the end of the hose 26 is a short length of rigid tubing 27, preferably of cooper or other suitable metal. The metal tubing 27 has a U-shaped bend 28 therein forming a permanent gas trap and, emerging from the trap, the delivery end 29 extends through a hole 29 in the wall of a drain pipe section 30 and sealed therein, as by soldering it in place. The delivery end 29 of the tube 27 is located close to the top of the pipe section 30 so as not to impede flow therethrough, and extends beyond it, as shown whereby the output is delivered beyond the pipe section 30. The drain pipe section 30 has threaded coupling means 32 and 34 adapting it to replace a like section in the drainpipe assembly 36 of a wash basin 38 and, specifically, that section of drain pipe connected to the outlet side of the sink trap 40, whereby any odors which might otherwise exist in the section 30 are blocked from exit to the sink drain 42 by the usual water in the trap 40 and, of course, gases are also blocked by liquids in the self-contained trap 28. Liquids exiting through the tube delivery 29 are dumped directly into the sewer line from the drainpipe section 30.

Also provided with the urinal assembly 10 is a wall bracket 44 having suitable means, such as adhesive strips or the like (not shown) for attachment to the wall of the room, adjacent the washbasin 38. Extending from the bracket 44 is a horizontal cover panel 46 to the underside of which is secured a spring clip device 48 which may comprise a pair of small rollers which are spring biased together but which may be cammed apart to receive the rim 50 around the open end 14 of the funnel 12 and hold it securely in place. In addition, complementary hook means 52 and 54 are provided on the cover panel 46 and funnel 12, respectively, so that the funnel may be held in place when not in use against the under-surface of the cover panel 46. When in use, the funnel 12 may be suspended by engaging the hook 52 through the eye 53 in the side of the funnel.

After the unit is installed, simply by hanging the wall bracket and inserting the pipe section 30 into the existing drain line 36, the funnel 12 may be used as a urinary receptacle and, after use, may be flushed clean with a cup or less of water from the adjacent washbasin 38 and thereafter hung in place on the bracket 44 by camming the rim 50 of the open end 16 between the rollers of the spring clip 48 while the complementary hook means 52 and 54 support the other side.

While this invention has been described in conjunction with a preferred embodiment thereof, it is obvious that modifications and changes made therein may be made by those skilled in the art without departing from the spirit and scope of this invention, as defined by the claims appended hereto.

What I claim as invention is:

1. A water conserving urinal comprising:

an open topped receptacle having an outlet port in the bottom thereof:

a length of flexible hose attached to said outlet port;

a short section of rigid tube attached to the end of said flexible hose.

a section of sink drain pipe adapted for connection to the outlet of a sink trap and having an opening in the top wall thereof:

said rigid tube extending into said opening;

means sealing said opening around said rigid tube; a bracket adapted to be mounted on a wall;

a horizontal cover panel extending from said bracket; and means for releasably securing said receptacle to said cover panel with the open top in engagement therewith.

2. The water conserving urinal defined by claim 1 wherein:

said rigid tube has a U-bend therein forming a self-contained gas trap.

3. The water conserving urinal defined by claim 1 wherein:

said receptacle is a funnel.

4. The water conserving urinal defined by claim 1 including:

a handle secured to the side of said receptacle.

5. The water conserving urinal defined by claim 1 wherein:

said last-named means comprises a spring clip; and including a rim around the open top of said receptacle to be received in said spring clip.

6. The water conserving urinal defined by claim 5 wherein:

said clip engages said rims at a joint on the circumference thereof; and including complementary hook means on said receptacle, on the circumference thereof opposite said joint, and on said cover panel.

7. The water conserving urinal defined by claim 1 including:

complementary means on said bracket and said funnel for suspending said funnel with the open top thereof free of said panel.

* * * * *